United States Patent [19]

Yates, Jr.

[11] Patent Number: 4,660,638

[45] Date of Patent: Apr. 28, 1987

[54] DOWNHOLE RECORDER FOR USE IN WELLS

[75] Inventor: Donald N. Yates, Jr., Katy, Tex.

[73] Assignee: Halliburton Company, Duncan, Okla.

[21] Appl. No.: 741,074

[22] Filed: Jun. 4, 1985

[51] Int. Cl.[4] ..... E21B 47/00

[52] U.S. Cl. ..... 166/250; 166/66; 166/55.1; 175/4.56; 175/40

[58] Field of Search ..... 166/250, 297, 113, 117.5, 166/55.1, 66; 175/4.51, 4.56, 4.52, 4.54, 4.55, 40; 73/151, 154

[56] References Cited

U.S. PATENT DOCUMENTS

| | | | |
|---|---|---|---|
| 4,006,777 | 2/1977 | LaBauve | 166/250 |
| 4,033,186 | 7/1977 | Bresie | 73/154 |
| 4,208,966 | 6/1980 | Hart | 175/4.55 X |
| 4,324,310 | 4/1982 | Werner et al. | 175/4.55 X |
| 4,478,294 | 10/1984 | Summer | 166/250 X |
| 4,480,690 | 11/1984 | Vann | 166/250 |
| 4,483,397 | 11/1984 | Gray | 166/250 |
| 4,593,771 | 6/1986 | Comeau | 175/48 |
| 4,598,771 | 7/1986 | Vann | 175/4.55 |

*Primary Examiner*—Stephen J. Novosad
*Assistant Examiner*—David J. Bagnell
*Attorney, Agent, or Firm*—James R. Duzan

[57] ABSTRACT

Method and apparatus for recording data downhole in a borehole. A recorder having a data memory is lowered into a data recording position in the borehole. A signal is transmitted downhole into the borehole and the recorder is initiated to begin recording data at an ascertainable memory location of the data memory in response to a downhole stimulus produced in response to the transmitted signal. Also, a downhole recorder for use in detecting the firing of an explosive device downhole in a borehole is provided. After an attempt is made to actuate the explosive device, the recorder is retrieved to the surface where the contents of its memory are analyzed to determine whether the explosive device has been actuated.

28 Claims, 6 Drawing Figures

DOWNHOLE RECORDER FOR USE IN WELLS

BACKGROUND

The present invention relates to downhole recorders for use in oil and gas wells.

Various types of downhole recorders have been developed for use in wells, for example, to measure pressure and temperature. One such well known recorder senses pressure via the expansion and contraction of a Bourdon tube. Data is recorded on a moving chart using a stylus mechanically linked to a moving end of the Bourdon tube. The recorder is large and intricate, having a relatively long length. The large size of the recorder may render it impractical for use in confined spaces and in highly deviated boreholes. When the recorder is retrieved to the surface, it is necessary to convert the analog trace from the chart to a usable format. Typically, the data is converted manually at considerable expense and with substantial delay.

Electronic recorders provide the advantage of small size and are capable of providing the data directly in digital form to data processing instrumentation. However, electronic recorders generally have more limited storage capacity than do mechanical recorders. U.S. Pat. No. 4,033,186 shows a downhole electronic recorder wherein a preprogrammed solid state clock initiates measurement sequences and deactivates the circuitry between sequences. A time delay is programmed into the clock so that the first reading sequence is not initiated until the gauge has been inserted into the well shaft to a desired depth.

In well testing and completion activities, the wall of the borehole is perforated, for example, to test the producing capability of a formation, or to bring a well into production. The wall is perforated typically with the use of a perforating gun which is either suspended in the well on a wireline or is run into the well on tubing. Especially where the gun is tubing conveyed, considerable time and expense are required to run in the guns, and it is desireable to reliably determine that the perforating guns have been successfully actuated.

Where a wireline gun is used to perforate a well, a sensor in the gun can be coupled to surface equipment by wire line in order to detect and convey signals indicative of gun firing. Such techniques utilize, for example: (1) an inertial switch disposed within the perforating gun and arranged to interrupt the electrical gun firing circuit in response to gun recoil from firing; (2) an accelerometer disposed within the perforating gun and arranged to generate an electrical signal in response to recoil motion of the perforating gun; and (3) a downhole microphone (geophone) arranged to convey the sound of the perforating gun to a speaker at the surface.

However, in the use of tubing conveyed perforating guns, there typically is no electrical conductor extending from the surface downhole to the gun, and the above mentioned techniques cannot be utilized for detecting its firing. In one known technique, an explosive device is attached to one end of a perforating gun which is actuated from an opposing end. When the gun is actuated, only the complete detonation of a detonating cord within the gun from the first end thereof to the second, where the explosive device is located, will suffice to actuate the explosive device. The explosive device implements a time delay so that complete detonation of the perforating gun is followed in time by several seconds by the actuation of the explosive device. A sensor at the wellhead detects energy produced by the firing of the perforating gun and, subsequently, energy from the firing of the explosive device, so that it can be reliably determined at the wellhead whether the gun has fired completely. This signalling technique works quite well under most circumstances. However, in environments where a great deal of background noise is present, for example, on a floating rig, the surface noise tends to obscure the signals from the perforating gun and the explosive device.

SUMMARY OF THE INVENTION

In accordance with one aspect of the present invention, a method is provided for recording data downhole in a borehole. A recorder having a data memory is lowered into a data recording position in the borehole. A signal is transmitted downhole into the borehole and the recorder is initiated to begin recording data at an ascertainable memory location of the data memory in response to a downhole stimulus produced in response to the transmitted signal. In this manner, the recorder can be maintained in a low power consumption mode of operation until it is actually desired to record data. Positive control over the initiation of recording is afforded and the most efficient use of memory capacity is achieved. Accordingly, in many applications, relatively compact and inexpensive electronic memory devices can be utilized in place of larger and mechanically intricate conventional recorders. The method of the present invention also permits the efficient utilization of mechanical recording devices by conserving memory space for the storage of useful data and facilitates data utilization by commencing data recording at an ascertainable memory location.

In accordance with a further aspect of the present invention, a method is provided for detecting the firing of an explosive device downhole in a borehole. The method includes lowering a recorder means into the borehole; transmitting a stimulus downhole for firing the explosive device; retrieving the recorder means from the borehole; and analyzing data recorded downhole by the recorder means to detect evidence of the firing of the explosive device. The method of the present invention is especially useful in detecting the actuation of a perforating gun, where the recorder means is positioned in close proximity to the gun. The recorder is thus enabled to receive and record relatively unattenuated signals emitted by the perforating gun when it fires, to reliably record the event.

In accordance with another aspect of the present invention, a system is provided for use in detecting the firing of an explosive device downhole in a borehole. A downhole recorder means is provided for recording a signal produced by the firing of the explosive device. Since the recorder means is downhole, energy produced from the firing of the explosive device is not appreciably attenuated when it reaches the recorder means resulting in a higher signal to noise ratio, making detection of the firing of the explosive device more likely. The system further includes means for providing an output based on the recorded signal to an operator at the surface.

In accordance with a further aspect of the present invention, a downhole recorder for recording the firing of a perforating gun downhole in a borehole is provided. The recorder comprises signal storage means for recording signals produced by the firing of the perforating gun. The signal storage means is actuable upon receipt of an actuation signal thereby. The recorder further comprises means for producing the actuation signal upon receipt of a stimulus indicating the firing of the perforating gun. Accordingly, it becomes possible to utilize electronic storage devices having limited memory capability for this purpose, since data only is stored upon the actuation of the perforating gun. In this manner, it is also possible to conserve batteries used to energize the circuitry of the recorder until such time as useful data is available for recording.

In accordance with yet another aspect of the present invention, a system is provided for testing an oil or gas well. The system comprises a perforating gun; downhole recorder means for storing test data; and means for actuating the downhole recorder means to commence storing test data therein in response to a signal indicating the firing of the perforating gun. Since it takes a considerable amount of time to run in a test string on a drill pipe, for example in performing a drill stem test, it is desireable to commence the recording of test data only after the drill string has been lowered to the desired depth and the perforating gun actuated. This avoids recording unnecessary data so that memory capacity is best utilized, and permits battery energy to be preserved.

In accordance with a still further aspect of the present invention, a system is provided for recording data downhole in a borehole. The system comprises a recorder means positioned downhole in the borehole; means for initiating the recording of data at an ascertainable memory location of the recorder means in response to a downhole stimulus produced in response to a transmitted signal; and means for transmitting the signal from the surface of the borehole downhole to the initiating means.

BRIEF DESCRIPTION OF THE DRAWINGS

The present invention, as well as further objects and features thereof, will be understood more clearly and fully from the following description of certain preferred embodiments when read with reference to the accompanying drawings, in which.

DETAILED DESCRIPTION OF CERTAIN PREFERRRED EMBODIMENTS

Figure 1:
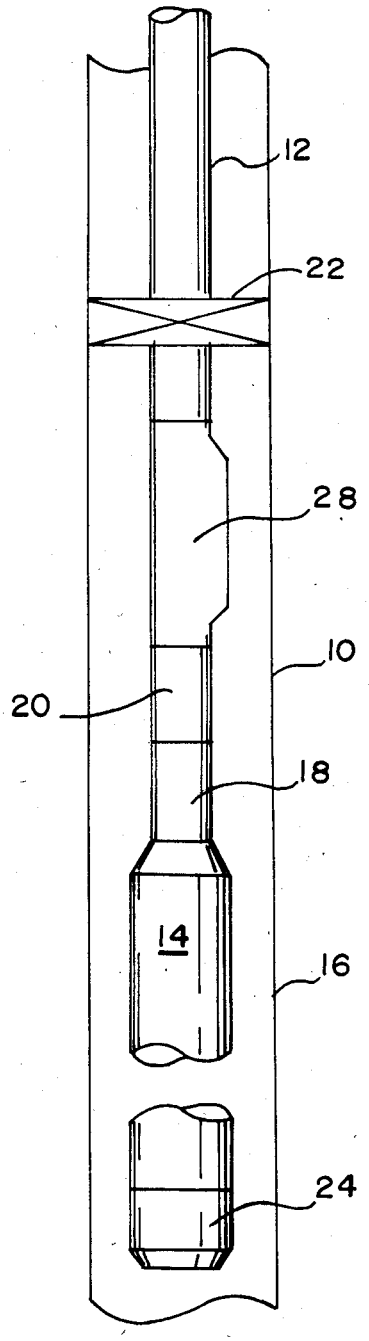
FIG. 1 is a partially cross-sectional, partially broken away view of a cased wellbore wherein a tubing string has been lowered to position perforating guns opposite a portion of the casing to be perforated.

With reference first to FIG. 1, a casing 10 lines a borehole in the earth. A tubing string 12 has been run into the borehole to position a string of perforating guns 14 suspended from the tubing string 12 opposite a portion 16 of the casing which it is desired to perforate. The purpose of forming the perforations may be, for example, to test the productive capabilities of a formation separated from the interior of the borehole by the casing portion 16, or to carry out a permanent completion of the well. A firing head 18 is threadedly coupled to an upper extremity of perforating guns 14. The firing head 18 may be, for example, a mechanical firing head which is actuated by the impact of a detonating bar dropped through the tubing 12 to impact the firing head, or a pressure actuated firing head. A vent assembly 20 is threadedly coupled to the firing head 18 at an upper extremity thereof and provides a means of communicating fluids to the interior of the tubing string 12 from the lower portion of the borehole. A packer 22 separates the lower portion of the borehole in which the perforating guns 14 are suspended from an upper borehole annulus.

A shot detection delay device 24 is threadedly coupled to a lower extremity of the perforating guns 14. The delay device 24 is arranged so that a detonating cord extending the entire length of the guns 14 will initiate a time delayed explosion within the delay device 24 provided the detonating cord detonates its entire length. The time delayed explosion within the delay device 24 occurs, for example, ten seconds after the detonation of the perforating guns 14 to produce a distinct signal which indicates that the perforating guns 14 have detonated their entire length. The delay device 24 is described in greater detail in co-pending U.S. patent application Ser. No. 505,911 filed June 20, 1983, in the names of Edward A. Colle, Jr. et al. and entitled METHOD AND APPARATUS FOR DETECTING FIRING OF PERFORATING GUN.

Figure 2:
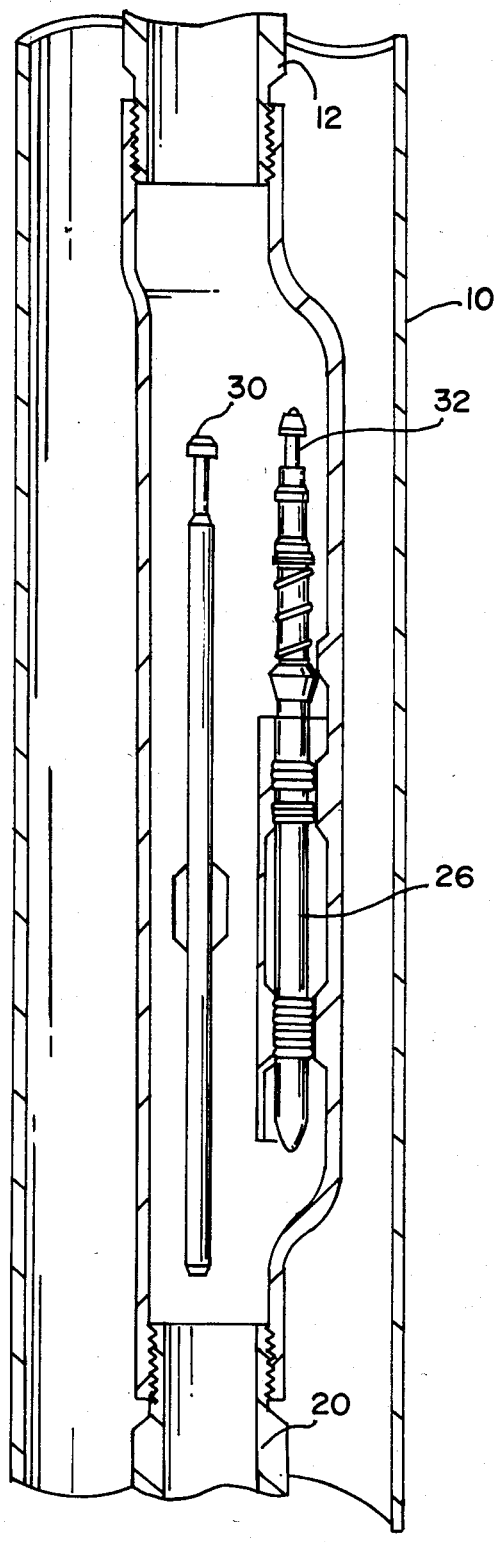
FIG. 2 is a partially cross-sectional view of the wellbore of FIG. 1, enlarged to illustrate a device in accordance with the present invention positioned in a side pocket mandrel for detecting the firing of the perforating guns.

With reference also to FIG. 2, a downhole recorder 26 is positioned in the side pocket of a side pocket mandrel 28 threadedly coupled at its lower extremity to the vent assembly 20 and at its upper extremity to a joint of the tubing string 12. The recorder 26 stores signals which bear a predetermined relationship to accelerations experienced by the recorder 26 due to the detonation of the perforating guns 14 and the subsequent actuation of the delay device 24. Due to the relatively close positioning of the downhole recorder 26 with respect to the perforating guns 14 and the delay device 24, the recorder 26 receives relatively strong accelerations from the actuation of these devices and, therefore, the accelerations are readily distinguishable from background noise.

The recorder 26 can be run in with the tubing string, or later lowered through the tubing string and landed in the side pocket with the use of conventional tools and techniques. When it is desired to fire the perforating guns, a detonating bar 30 (see FIG. 2) is dropped through the tubing string 12 so that it impacts the firing head 18 to detonate the guns 14. It will be appreciated that the placement of the recorder 26 in the side pocket mandrel permits the detonating bar 30 to pass therethrough unobstructed. The very strong accelerations experienced by the tubing string and the side pocket mandrel therein as a result of the actuation of the guns 14 triggers the recording mode of the recorder 26 which thereupon records accelerations for a short period of time, for example, 40 seconds. Within that span of time, the shot detection delay device 24 will be activated if the perforating guns 14 have detonated their entire length, and the resultant acceleration of the tubing string will be recorded by the recorder 26. Thereafter, the recorder 26 is retrieved from the side pocket mandrel to the surface by means of a fishing tool which latches onto a fishing neck 32 of the recorder 26. Thereupon, the data stored in the recorder 26 is transferred to a surface unit (described in greater detail below) which then is capable of providing the same data in digital format for data processing purposes, and also in analog format which can be displayed, for example, for analysis on a strip chart. While the use of the delay device 24 is often helpful in detecting gun firing, its use is not essential in the practice of the present invention.

Figure 3:
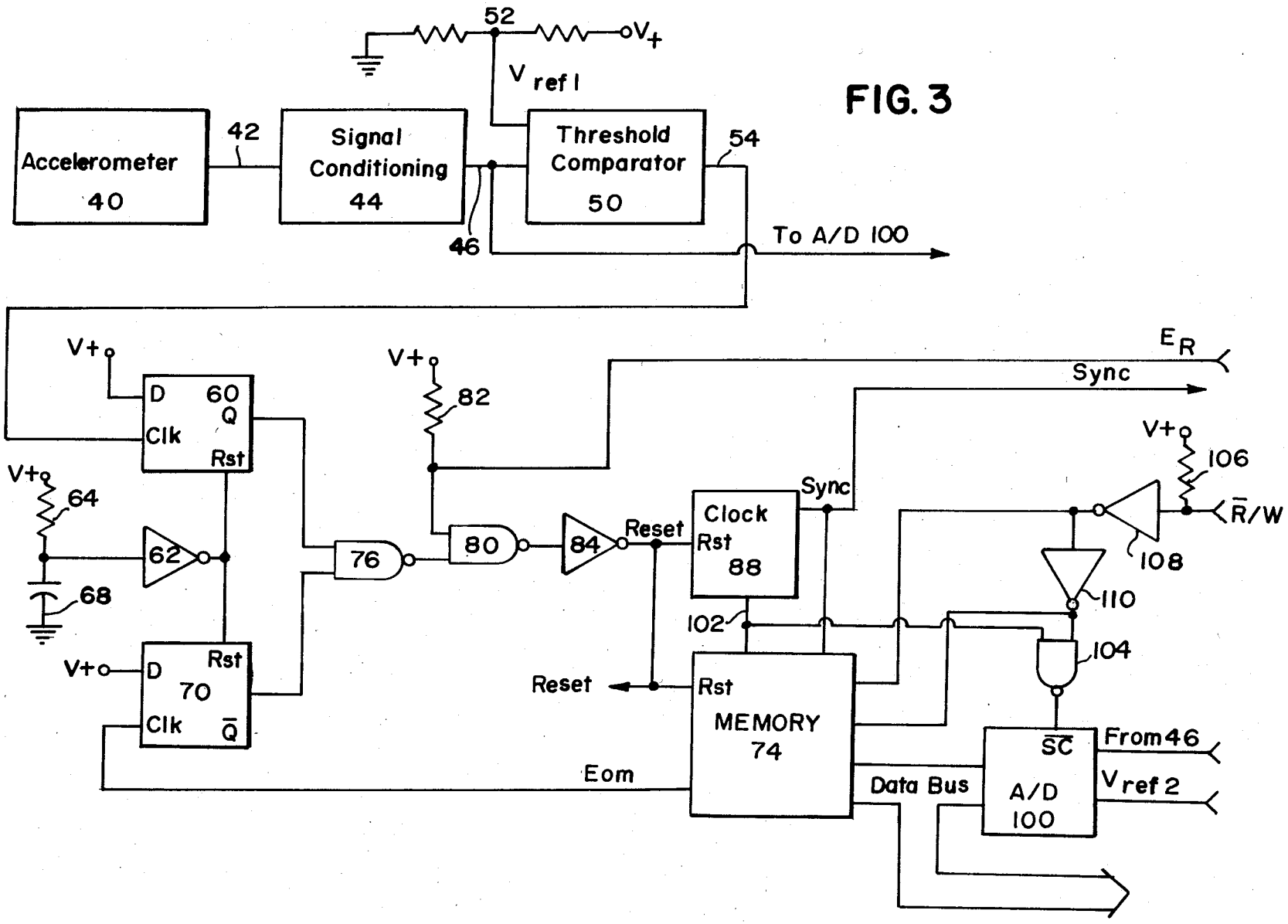
FIG. 3 is a block diagram of the signal detecting and recording circuitry encased in the device of FIG. 2.

The block diagram of FIG. 3 illustrates the circuitry of the recorder 26. The circuitry is protected by a pressure-tight housing of the recorder which also encloses a battery supply (not shown) for the circuitry. An accelerometer 40 is operative to continuously provide an electrical signal on its output 42, the signal being proportional to the accelerations experienced by the accelerometer 40 within the recorder 26. The output 42 of the accelerometer 40 is coupled to the input of signal conditioning circuit 44. The electrical signal provided by the accelerometer 40 at its output has a relatively low amplitude; accordingly, the signal conditioning circuit 44 has an input amplifier which boosts the amplitude of the signal provided on the output 44. The amplified signal is then rectified by a precision rectifier of the signal conditioning circuit 44 which then provides the thus - rectified signal to an output 46. The signal thus provided at output 46 is a single polarity signal proportional in amplitude to accelerations experienced by the recorder.

The signal provided at output 46 is used both as an input to the recorder's memory for storing acceleration data, and also is used to determine when the guns have fired, so that data is then recorded until the memory has been filled. The circuitry which serves to control the storage of data is first discussed below.

A threshold comparator 50 has an input coupled with the output 46 of the signal conditioning circuit 44. An input of the threshold comparator 50 is coupled to a voltage divider 52 which provides a reference voltage $V_{ref1}$. Threshold comparator 50 provides a low level on an output 54 thereof until it receives a signal from the output 46 of the signal conditioning circuit 44 which exceeds $V_{ref1}$ in amplitude, whereupon a high voltage level, or logic 1, is provided by the comparator 50 to its output 54. The reference voltage $V_{ref1}$ is equal in magnitude to the voltage which appears on output 46 when the accelerometer 40 experiences an acceleration of 500 g's. It is in this manner that the circuit of FIG. 3 detects that the guns have been fired, since the accelerometer will thereupon experience an acceleration in excess of 500 g's, while it is most unlikely that the accelerometer will experience such an acceleration beforehand.

A first D-type flip-flop circuit 60 has its D input held at a high voltage level $V_+$ and its clock input coupled to the output 54 of the threshold comparator 50. The reset terminal Rst of flip-flop 60 is connected to the output of an inverter 62. The input of inverter 62 is connected to the junction of a resistor 64 and a capacitor 68. The second terminal of resistor 64 is connected to $V_+$, while the second terminal of the capacitor 68 is connected to ground. Accordingly, when power is first applied to the circuit of FIG. 3, a low level voltage will be supplied to the input of the inverter 62, such that a high voltage level is initially provided to the reset terminal of flip-flop 60. Flip-flop 60 is, therefore, initially reset. After several seconds, the capacitor 68 has charged up sufficiently to bring the output of the inverter 62 low, so that flip-flop 60 can be set when a high level is supplied to its clock input by the output 54 of the threshold comparator 50. A second D-type flip-flop 70 has its D input coupled to the voltage level $V_+$ and its reset terminal Rst connected to the output of inverter 62. Accordingly, like flip-flop 60, flip-flop 70 will be reset initially when power is supplied to the circuit of FIG. 3. The clock terminal of flip-flop 70 is connected to an output $E_{OM}$ of a memory circuit 74. The voltage level on the output $E_{OM}$ is initially low.

A first input of a two input NAND gate 76 is coupled to the Q terminal of the flip-flop 60 and a second input to the NAND gate 76 is coupled to the $\overline{Q}$ terminal of the flip-flop 70. Since flip-flop 60 is initially reset, the output of NAND gate 76 initially is high.

The output of NAND gate 76 is coupled to one input of a two input NAND gate 80. A second input of NAND gate 80 is coupled through a resistor 82 to the positive voltage level $V_+$. Also coupled to the second input of NAND gate 80 is an external reset line $E_R$ whose purpose will be explained below in connection with the circuit of FIG. 4. Since both inputs of NAND gate 80 are initially high, the output thereof is initially low. The input of an inverter 84 is coupled to the output of NAND gate 80. The output of the inverter 84 is a Reset line coupled to a reset input Rst of memory circuit 74 and also to a reset input Rst of a clock circuit 88. It will be appreciated that the voltage level on the reset line will be initially high due to the initially low voltage level at the output of NAND gate 80. The high level on the reset line serves to disable the clock circuit 88 from producing clock pulses and also resets a memory address counter of memory circuit 74. At this point the recorder is operating in a standby mode. When the reset line is brought low, as explained below, the clock circuit 88 will begin producing a first clock pulse on a Sync output which is coupled to the address counter of memory circuit 74. A low level on the reset line also enables the address counter of memory circuit 74 to begin accumulating a count under the control of the signal from the clock circuit 88. Since the memory address counter is reset just before data storage begins, the first byte of data is stored at an ascertainable location in memory. Each subsequently received byte is stored in a sequentially addressed location as the counter is incremented.

An analog-to-digital converter circuit A/D 100 has a data input coupled to the output terminal 46 of signal conditioning circuit 44 to receive the amplified and rectified signal from the accelerometer 40. A second input of A/D 100 is connected to a reference voltage source $V_{ref2}$ to serve as a reference in performing its analog to digital conversion of the signal received from the output 46. Digitized versions of the accelerometer signal from output 46 are provided by A/D 100 to an 8 bit data bus coupled to the data terminals of the memory circuit 74. The data bus is also coupled to an output plug for transferring data to the surface unit, as explained below.

Internal control over the analog to digital conversion and memory storage process is maintained by a second clock signal produced by the clock circuit 88 on an output terminal 102 thereof. This signal is coupled both to memory circuit 74 and to a first input of a two input NAND gate 104. The output of NAND gate 104 is connected to a start conversion terminal $\overline{SC}$ of A/D 100. Read/write control is achieved through an external input terminal $\overline{R}/W$ coupled both to a first terminal of a resistor 106 and the input terminal of an inverter 108. A second terminal of the resistor 106 is connected to the positive voltage source $V_+$. The output of inverter 108 is coupled both to the first of a pair of read/write control lines of memory circuit 74 and to the input terminal of a further inverter 110. The output of inverter 110 is coupled to the second of the two read/write control lines of memory 74 and also to the second input of NAND gate 104.

Figure 4:
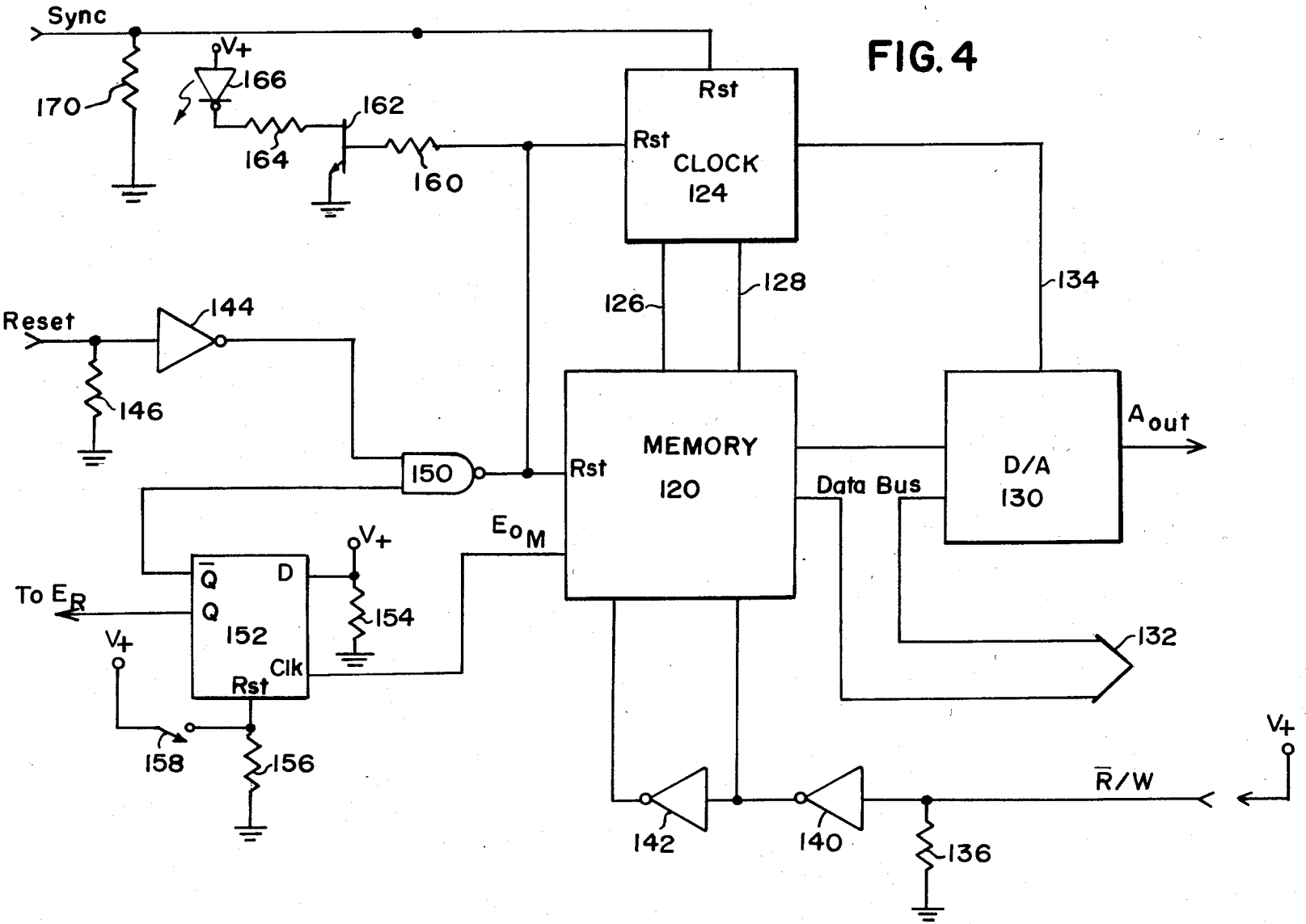
FIG. 4 is a block diagram of an electronic circuit incorporated in a surface unit for storing data recorded in the circuitry of FIG. 3 and providing such data to data processing instrumentation and to visual display devices.

When the circuit of FIG. 3 is not coupled to the surface unit of FIG. 4, for example, while the recorder is downhole and recording data, it is in the write mode. In the write mode, the $\overline{R}/W$ terminal is tied through resistor 106 to $V_+$ so that the input to the inverter 108 is high. Consequently, the first and second read/write control lines of the memory circuit 74 are respectively at low and high voltage levels, while the second input to NAND gate 104 is high. This places the memory circuit 74 in the write mode so that data received on the data bus from A/D 100 can be stored in memory at the sequential addresses determined by incrementing the memory counter of the circuit 74 after the Reset line has been brought low. As the memory counter is incremented by one count to generate a new memory address, the clock signal on the terminal 102 is brought high by the clock circuit 88 to generate a low voltage at the SC terminal of A/D 100, so that the present analog voltage from the output 46 of the signal conditioning circuit 44 is digitized by A/D 100. Then the voltage level on terminal 102 is brought low by the clock circuit 88 after sufficient time has passed to complete the analog to digital conversion, so that the memory circuit 74 is enabled to store the digitized signal provided on the data bus by the analog to digital converter 100.

When the memory counter has generated the last of the sequential addresses, the voltage level on line $E_{OM}$ is brought high clocking a low level into the $\overline{Q}$ terminal of the flip-flop 70. Consequently, a high voltage level is established on the Reset line so that the clock circuit 88 is disabled and the memory counter of memory circuit 74 is reset. Data storage thus is terminated and the already stored data is stored in memory 74 until it is desired to transfer the contents thereof to the suface unit.

With reference now to FIG. 4, the circuitry of the surface unit here illustrated includes a memory circuit 120 structurally identical to memory circuit 74 of FIG. 3. The circuit of FIG. 4 also includes a clock circuit 124 providing the necessary clock signals to memory circuit 120 over lines 126 and 128. The data bus of the memory circuit 120 is coupled with the data bus of a digital-to-analog converter D/A 130 having a single analog output terminal $A_{out}$. The data bus is also available to exterior circuitry through a plug connection shown as 132. The operation of D/A 130 is synchronized with that of the memory circuit 120 by virtue of clock signals provided to D/A 130 from clock circuit 124 over line 134.

Read/write control of the surface unit is achieved externally over input $\overline{R}/W$. When the surface unit is not connected to the recorder circuit of FIG. 3, input $\overline{R}/W$ is tied to ground through a resistor 136. The terminal $\overline{R}/W$ is also connected to the input of an inverter 140 whose output is connected (1) to a first read/write control line of memory circuit 120 and (2) to the input of an inverter 142. The output of inverter 142 is coupled to a second read/write input of memory 120. In the absence of external connection to the terminal $\overline{R}/W$, therefore, the first read/write input to memory 120 has a high voltage level, and the second input has a low voltage level, which corresponds with the read mode of memory circuit 120.

A further inverter 144 has an input coupled through a resistor 146 to ground and also to a plug terminal which is coupled to the Reset line of the circuit of FIG. 3 when it is plugged into the surface unit of FIG. 4. The output of inverter 144 is connected to the first input of a two input NAND gate 150. The second input of NAND gate 150 is connected with the $\overline{Q}$ terminal of a D type flip-flop 152. The D terminal of flip-flop 152 is coupled both to a positive voltage level $V_+$ and also to the first terminal of a resistor 154. A second terminal of resistor 154 is coupled to ground. The reset terminal Rst of flip-flop 152 is coupled to the first terminal of a resistor 156 whose second terminal is also coupled to ground. A first terminal of an SPST momentary contact switch 158 is also coupled to the reset terminal of flip-flop 152. The second terminal of switch 158 is connected to $V_+$. The clock terminal of flip-flop 152 is connected to the $E_{OM}$ terminal of memory circuit 120. The Q terminal of flip-flop 152 is connected to a plug terminal which in turn is coupled to the external reset $E_R$ terminal of the circuit of FIG. 3 when the surface unit is connected thereto.

The output of NAND gate 150 is connected (1) to the reset terminal Rst of memory circuit 120, and (2) to a first reset terminal Rst of clock circuit 124, and (3) to a first terminal of a resistor 160. The second terminal of resistor 160 is connected to the base terminal of an NPN transistor 162, whose emitter is coupled to ground. The collector of transister 162 is connected to the first terminal of a resistor 164 whose second terminal is connected to the cathode of a light emitting diode LED 166. The anode of LED 166 is connected to $V_+$. A second reset terminal Rst of clock 124 is connected to a first terminal of a resistor 170 whose second terminal is coupled to ground. The second reset terminal of clock circuit 124 is also coupled to a plug terminal which is connected to the Sync line of the FIG. 3 circuit when it is plugged to the surface unit.

In operation, the surface unit is turned on before the recorder is connected thereto. Then the momentary contact switch 158 is temporarily depressed to reset flip-flop 152. Accordingly, there is a high level on the $\overline{Q}$ terminal of flip-flop 152 and also at the output of inverter 144. At the same time, the output of NAND gate 150 is low which enables the memory counter of memory circuit 120. Since both reset terminals of clock 124 are low, clock 124 is enabled to produce clock pulses so that the memory counter of memory circuit 120 gradually accumulates a count. When the memory circuit 120 has cycled through completely, line $E_{OM}$ goes high clocking a low level into the $\overline{Q}$ terminal of flip-flop 152. This brings the output of NAND gate 150 high so that clock circuit 124 is reset together with the memory counter of memory circuit 120. At this point the recorder which has been retrieved from the borehole may be connected to the surface unit to transfer data thereto.

With reference both to FIGS. 3 and 4, connecting the downhole recorder to the surface unit connects the Sync terminal of the recorder to the Sync terminal of the surface unit, the Reset line of the recorder to the Reset terminal of the surface unit, the external Reset line $E_R$ to the corresponding terminal of the surface unit, and the data bus of the recorder to that of the surface unit. In addition, the recorder applies a high voltage level to the $\overline{R}$/W terminal of the surface unit, so that the memory 120 is now in the write mode. Connecting the surface unit to the recorder also ties the $\overline{R}$/W terminal of the recorder to ground through the surface unit, so that the recorder is presently in the read mode.

Since the flip-flop 152 of the surface unit is presently set, its Q terminal is at a high voltage level which maintains the previously reset condition of the recorder. To initiate data transfer, the switch 158 is temporarily closed to reset flip-flop 152. This brings the Q terminal of flip-flop 152 low, so that the Reset line of the recorder (FIG. 3) is now low. Since the Reset line of the recorder is now low, the output of inverter 144 in FIG. 4 is now high, and since flip-flop 152 has been reset, its $\overline{Q}$ terminal also is high. Accordingly, the reset line coupled to the output of NAND gate 150 is now brought low, so that clock circuit 124 and the memory counter of memory circuit 120 are enabled. The clock of the recorder is also enabled so that it begins to produce clock pulses for incrementing the memory counter of memory circuit 74 (FIG. 3). Since the Sync line from clock circuit 88 is connected to the second reset terminal of clock circuit 124, clock circuit 124 is constrained to count in synchrony with clock circuit 88, so that the address accumulated in memory circuit 74 corresponds to that accumulated in memory circuit 120 as data is transferred.

When the entire contents of memory circuit 74 have been read out, line $E_{OM}$ of FIG. 3 is brought high, clocking a low level into the $\overline{Q}$ terminal of flip-flop 70. Since the counter of memory circuit 120 of FIG. 4 has also reached its maximum count, its line $E_{OM}$ is also brought high at the same time clocking a high level into the Q terminal of flip-flop 152. Since the external reset $E_R$ line is now high and the output of NAND gate 76 of FIG. 3 is also high, the Reset line of the recorder is likewise high, disabling clock circuit 88 and the memory address counter. As a consequence also, the output of inverter 144 of FIG. 4 will be low (along with the $\overline{Q}$ terminal of flip-flop 152 which has just been clocked low by the rising edge of $E_{OM}$), so that the address counter of memory circuit 120 and clock circuit 124 of FIG. 4 also are reset.

The recorder may now be disconnected from the surface unit, as the contents of its memory have been transferred to that of the surface unit. The data contained in the memory circuit of the surface unit may be transferred in digital form to permanent storage (for example, on tape) for further processing, and it can also be recorded in analog form (for example, on a strip chart) through the $A_{OUT}$ terminal of D/A 130. Visual inspection of the strip chart record will reveal whether guns 14 have fired.

Figure 5A:
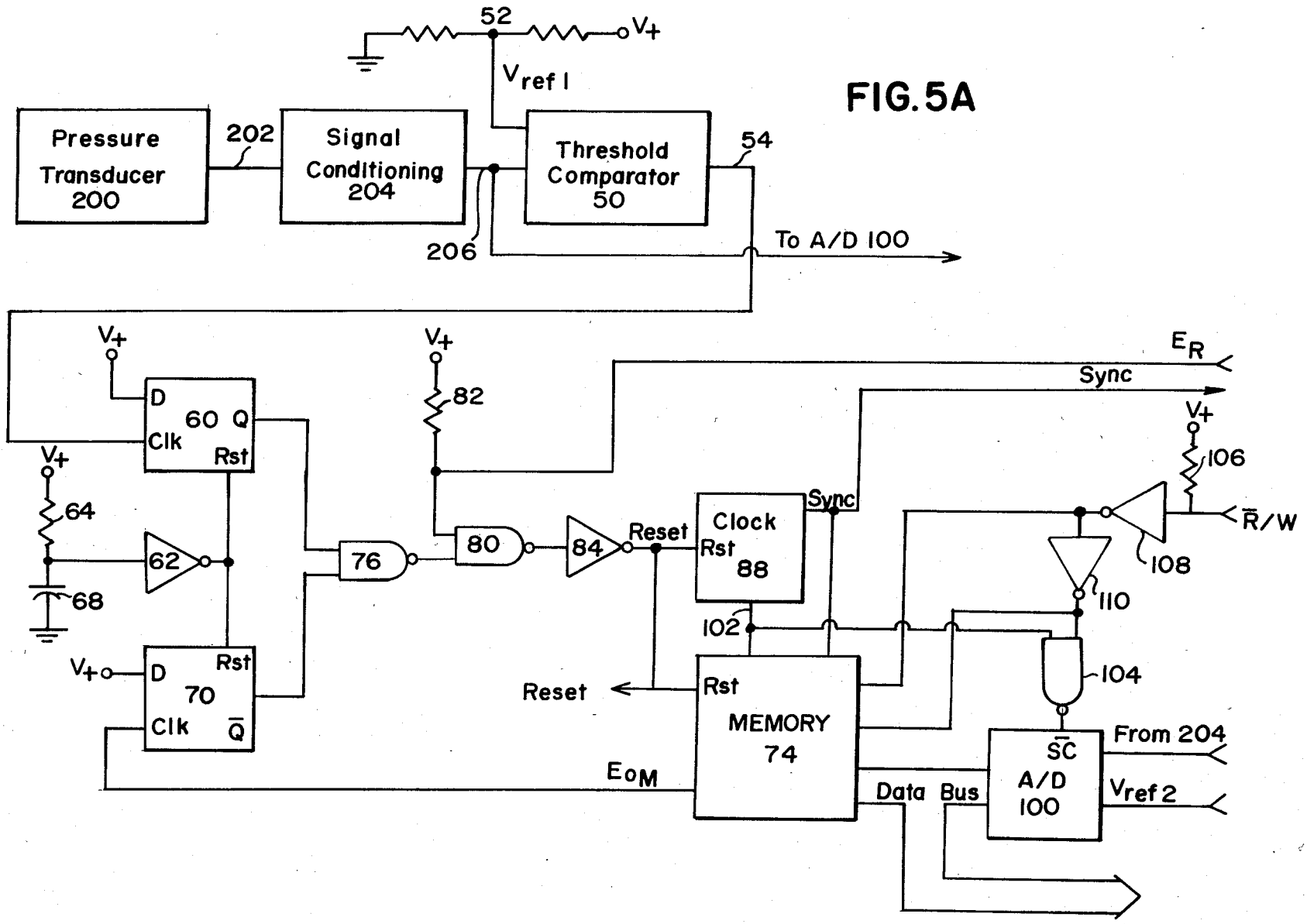
FIGS. 5A and 5B are block diagrams of test data recording circuitry which can be incorporated in the device of FIG. 2, in place of the circuit of FIG. 3.

The present invention is also applicable to the recording of test data, for example, pressure data, temperature data, etc. With reference to FIG. 5A, a recorder circuit for use in recording pressure data is shown in block form. Elements of FIG. 5A corresponding to those of FIG. 3 bear the same reference numerals. A pressure transducer 200 is exposed to fluid pressure on the exterior of the recorder and generates a signal bearing a known relationship with such fluid pressure. An output terminal 202 of pressure transducer 200 is coupled to an input terminal of a signal conditioning circuit 204. Signal conditioning circuit 204 amplifies the signal from the pressure transducer 200 and provides such amplified signal as a single polarity signal on an output terminal 206. Output terminal 206 is connected both to the input of threshold comparator 50 and to the input of analog-to-digital convertor A/D 100. Upon the firing of a perforating gun, a sudden increase in fluid pressure is experienced in the lower portion of the borehole. Pressure transducer 200 thereupon produces an output signal of relatively large magnitude which is sufficient to cause threshold comparator 50 to output a high voltage level, such that the record mode of the memory is initiated. As in the case of the circuit of FIG. 3, in the circuit of FIG. 5A, the output of the signal conditioning circuit is provided to the input of the analog-to-digital converter A/D 100 to be digitized for storage in the memory circuit 74. In a typical drill stem test, it is unnecessary to sample the pressure data at high rates; accordingly, the clock circuit 88 can be adjusted to produce clock pulses of relatively low frequency so that the memory 74 is enabled to record pressure data over a correspondingly longer period of time than that provided in the case of the circuit of FIG. 3. In the alternative, the circuit of FIG. 5A may be utilized for shot detection, in which case the clock frequency is accordingly adjusted.

Figure 5B:
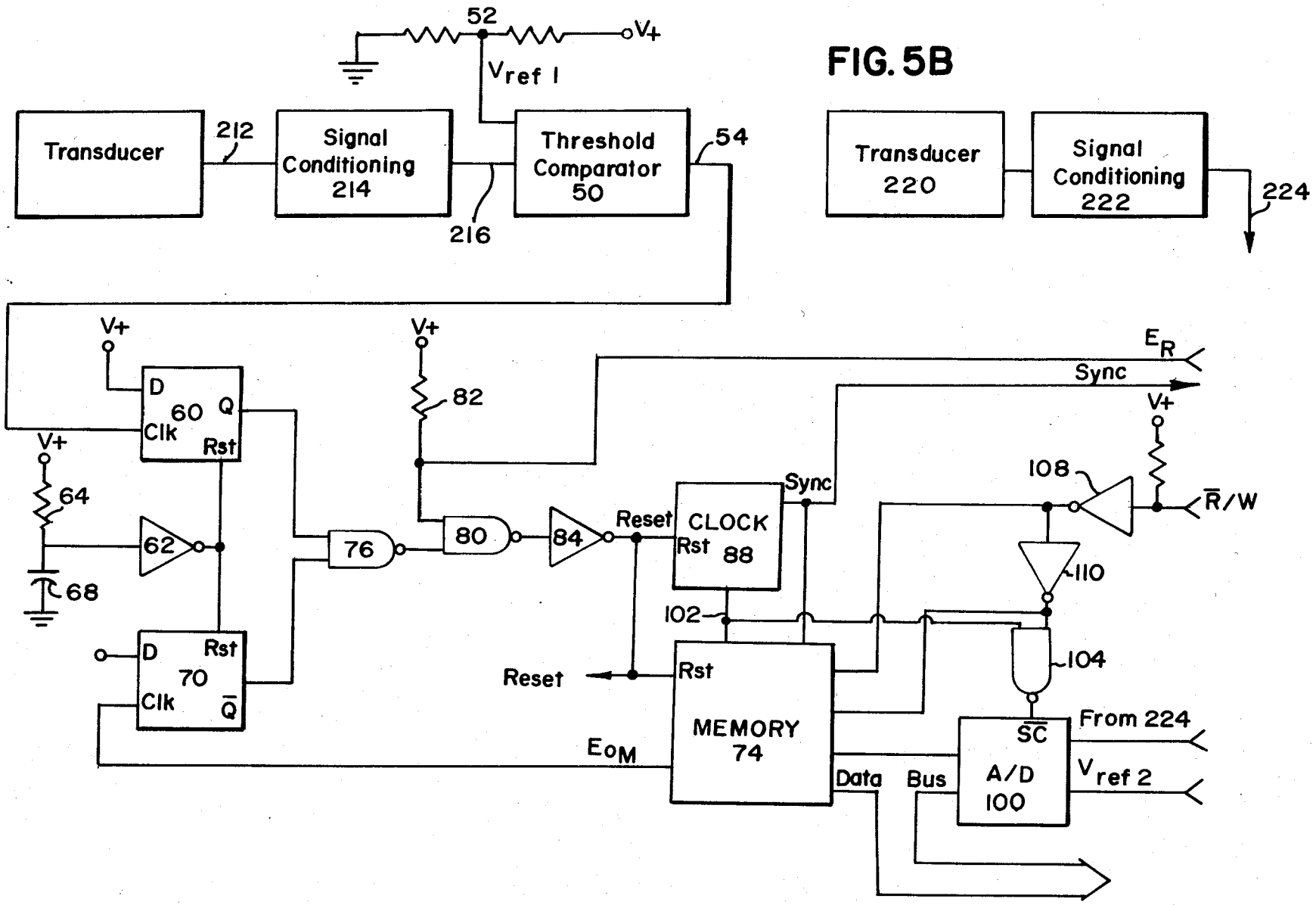

With reference now to FIG. 5B, a further modification of the recorder circuit of FIG. 3 is illustrated in block format. In FIG. 5B, elements corresponding to those in FIG. 3 bear the same reference numerals. In FIG. 5B, a transducer 220 is used to produce data to be recorded in the memory of the circuit. For example, transducer 220 may be a thermocouple which serves to produce a signal bearing a known relationship with downhole temperature. The output signal from the transducer 220 is provided to an input of a signal conditioning circuit 222 having an output of 224 connected to the data input of analog-to-digital converter A/D 100. Signal conditioning circuit 222 serves to amplify the signal from transducer 220 and provides a signal polarity version thereof on its output line 224. A second transducer 210 has an output 212 coupled to the input of a signal conditioning circuit 214. Signal conditioning circuit 214 has an output 216 coupled to the input of threshold comparator 50. In one embodiment of the FIG. 5B circuit, transducer 210 produces an electrical pulse in response to changes in magnetic flux. In this manner, transducer 210 produces one or more pulses as the detonating bar 30 drops past the recorder 26, as shown in FIG. 2. These pulses are amplified and rectified by signal conditioning circuit 214 and serve to stimulate threshold comparator 50 to output a logic 1 on line 54. Accordingly, the record mode is thus initiated just prior to impact of the detonating bar with the firing head. In an alternative embodiment, acccelerometer 40 and signal conditioning circuit 44 are substituted for transducer 210 and signal conditioning circuit 214. In a further alternative embodiment, the transducer 210 is replaced by a pressure transducer in communication with fluid pressure in the borehole annulus above the packer 22. This could be achieved, for example, by placing the side pocket mandrel, or other carrier for the recorder, above the packer and introducing upper borehole annulus fluid pressure to the pressure transducer through an aperture in the wall of the side pocket mandrel or other carrier for the recorder.

Further modifications within the scope of the present invention include incorporating the circuitry of one of FIGS. 3, 5A and 5B in a detonating bar, such as detonating bar 30 of FIG. 2. When it is desired to actuate the perforating gun, the detonating bar incorporating the recorder is dropped down the tubing string 12, so that it impacts the firing head 18 thus to actuate the perforating gun 14. Energy released by the perforating gun 14 thereupon actuates the record mode of the recorder in the detonating bar 30, whether by subjecting the recorder to a sufficiently large acceleration or fluid pressure pulse, or otherwise. Thereafter, the detonating bar is retrieved to the surface either by fishing it or by pulling the tubing string.

In a further embodiment, the recorder 26 enclosing the circuit of FIG. 3 is hard mounted to a pup joint arranged beneath the perforating guns. Upon gun actuation, the recorder stores acceleration data indicating the magnitude of forces generated by the guns downhole, which is useful in the design of downhole tools to operate in conjunction with perforating guns. In another embodiment, the recorder is mounted in a gauge carrier and encases the circuit of FIG. 5A for measuring pressure downhole, or else encases the circuit of FIG. 5B for measuring downhole temperature.

The present invention is equally applicable to mechanical recorders. In one illustrative embodiment, a mechanical pressure recorder utilizes a Bourdon tube to transduce pressure to the fluctuation of a stylus. The stylus scribes an analog record of pressure over time on a plate moved past the stylus by a clock mechanism. Movement of the plate past the stylus is initiated upon the receipt of a signal indicating the firing of a perforating gun. For example, a large acceleration of the recorder experienced as a result of gun firing enables the clock mechanism to advance the plate. Pressure signals and other forms of signals originating from or produced in response to signals originating from the wellhead can also utilized for this purpose.

The terms and expressions which have been employed are used as terms of description and not of limitation, and there is no intention in the use of such terms and expressions of excluding any equivalents of the features shown and described, or portions thereof, it being recognized that various modifications are possible within the scope of the invention claimed.

What is claimed is:

1. A method of recording data and initiating a perforating gun downhole in a borehole comprising the steps of:

lowering a perforating gun into the borehole;

lowering a recorder having a data memory into a data recording position in the borehole;

transmitting a signal downhole into the borehole;

initiating the recorder to begin recording data at an ascertainable memory location of the data memory in response to a downhole stimulus produced in response to the transmitted signal; and initiating the perforating gun in response to transmitting a signal downhole.

2. The method of claim 1, wherein the step of transmitting the signal comprises transmitting a perforating gun actuation signal downhole.

3. The method of claim 2, wherein the step of transmitting the signal comprises lowering a weighted object downhole to actuate the perforating gun; and the step of initiating the recorder comprises initiating the recorder in response to energy produced by the actuation of the perforating gun.

4. The method of claim 2, wherein the step of transmitting the signal comprises lowering a weighted object downhole to actuate the perforating gun; and the step of initiating the recorder comprises detecting the lowering of the weighted object to produce an initiation signal and initiating the recorder under the control of the initiation signal.

5. The method of claim 2, wherein the step of transmitting the signal comprises adjusting fluid pressure downhole for actuating the perforating gun; and the step of initiating the recorder comprises initiating the recorder in response to energy produced by the actuation of the perforating gun.

6. The method of claim 2, wherein the step of transmitting the signal comprises adjusting fluid pressure downhole for actuating the perforating gun; and the step of initiating the recorder comprises detecting the adjustment of fluid pressure downhole to produce an initiation signal and initiating the recorder under the control of the initiation signal.

7. The method of claim 2, wherein the step of lowering the recorder comprises lowering the recorder attached to a weighted object; and wherein the step of transmitting the signal comprises lowering the weighted object into contact with a firing mechanism of the perforating gun.

8. The method of claim 2, wherein the step of initiating the recorder comprises producing an initiation signal in response to the firing of the perforating gun and initiating the recorder under the control of the initiation signal.

9. The method of claim 1, further comprising the step of recording well test data in the data memory.

10. The method of claim 9, wherein the step of initiating the recorder comprises initiating the recorder in response to the firing of a perforating gun downhole.

11. A method of detecting the firing of an explosive device downhole in a borehole, comprising:

lowering a recorder means into the borehole;

transmitting a stimulus downhole for firing the explosive device;

retrieving the recorder means from the borehole; and analyzing data recorded by the recorder means downhole to detect evidence of the firing of the explosive device.

12. The method of claim 11, wherein the explosive device is a perforating gun, and the step of analyzing the recorded data comprises inspecting the data for evidence of gun firing.

13. A downhole recorder for recording the firing of a perforating gun downhole in a borehole, comprising:

signal storage means for recording signals produced by the firing of the perforating gun;

the signal storage means being actuable upon receipt of an actuation signal thereby; and means for producing the actuation signal upon receipt of a stimulus indicating the firing of the perforating gun.

14. The recorder of claim 13, wherein the means for producing the actuation signal is operable to produce the actuation signal upon receipt of an acceleration stimulus produced by the firing of the perforating gun.

15. The recorder of claim 13, wherein the means for producing the actuation signal is operable to produce the actuation signal upon receipt of a stimulus produced by a detonating bar lowered through the borehole in proximity of the recorder.

16. The recorder of claim 13, wherein the means for producing the actuation signal is operable to produce the actuation signal upon receipt of a fluid pressure stimulus downhole in the borehole.

17. The recorder of claim 13, wherein the recorder is attached to a detonating bar.

18. The recorder of claim 13, wherein the signal storage means has a standby mode of operation and a record mode of operation, and wherein the signal storage means is actuable to the record mode from the standby mode upon receipt of the actuation signal.

19. A system for testing an oil or gas well, comprising:

a perforating gun;

downhole recorder means for storing test data; and means for actuating the downhole recorder means to commence storing test data therein in response to a signal indicating the firing of the perforating gun.

20. The system of claim 19, wherein the downhole recorder means is operative to store downhole pressure data.

21. The system of claim 19, wherein the downhole recorder means is operative to store downhole temperature data.

22. A system for recording data downhole in a borehole, comprising:

a recorder means positioned downhole in the borehole;

means for initiating the recording of data at an ascertainable memory location of the recorder means in response to a downhole stimulus produced in response to a transmitted signal, the means for initiating the recording of data comprising:

means for initiating the recording of data in response to a stimulus produced by the firing of a perforating gun downhole; and means for transmitting the signal from the surface of the borehole downhole to the initiating means, the means for transmitting the signal comprising:

a detonating bar.

23. A method of recording data downhole in a borehole, comprising the steps of:

lowering a recorder having a data memory into a data recording position in the borehole;

transmitting a perforating gun actuation signal downhole into the borehole by lowering a weighted object downhole to actuate the perforating gun; and initiating the recorder to begin recording data at an ascertainable memory location of the data memory in response to energy produced by the actuation of the perforating gun.

24. A method of recording data downhole in a borehole, comprising the steps of:

lowering a recorder having a data memory into a data recording position in the borehole;

transmitting a perforating gun actuation signal downhole into the borehole by lowering a weighted object downhole to actuate the perforating gun; and detecting the lowering of the weighted object to produce an initiation signal and initiating the recorder under the control of the initiation signal.

25. A method of recording data downhole in a borehole, comprising the steps of:

lowering a recorder having a data memory into a data recording position in the borehole;

transmitting a perforating gun actuation signal downhole into the borehole by adjusting fluid pressure downhole for actuating the perforating gun; and initiating the recorder to begin recording data at an ascertainable memory location of the data memory in response to energy produced by the actuation of the perforating gun.

26. A method of recording data downhole in a borehole, comprising the steps of:

lowering the recorder having a data memory into a data recording position in the borehole;

transmitting a perforating gun actuation signal downhole into the borehole by adjusting fluid pressure downhole for actuating the perforating gun; and detecting the adjustment of fluid pressure downhole to produce an initiation signal and initiating the recorder under the control of the initiation signal.

27. A method of recording data downhole in a borehole, comprising the steps of:

lowering a recorder having a data memory into a data recording position in the borehole by attaching the recorder to a weighted object;

transmitting a perforating gun actuation signal downhole into the borehole by lowering the weighted object downhole to actuate the perforating gun by the weighted object contacting with a firing mechanism of the perforating gun; and initiating the recorder to begin recording data at an ascertainable memory location of the data memory in response to a downhole stimulus produced in response to the transmitted signal.

28. A method of recording data downhole in a borehole, comprising the steps of:

lowering a recorder having a data memory into a data recording position in the borehole;

transmitting a perforating gun actuation signal downhole into the borehole; and producing an initiation signal in response to the firing of the perforating gun and initiating the recorder under the control of the initiation signal.

* * * * *